US007171725B2

(12) United States Patent
Sjoberg et al.

(10) Patent No.: US 7,171,725 B2
(45) **Date of Patent: *Feb. 6, 2007**

(54) VACUUM CLEANER DEVICE WITH A SCREW CONVEYOR

(75) Inventors: Goran Sjoberg, Kungsangen (SE); Fredrik Bergling, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 459 days.

This patent is subject to a terminal disclaimer.

(21) Appl. No.: 10/250,982

(22) PCT Filed: Dec. 20, 2001

(86) PCT No.: PCT/SE01/02878

§ 371 (c)(1),
(2), (4) Date: Jul. 10, 2003

(87) PCT Pub. No.: WO02/054928

PCT Pub. Date: Jul. 18, 2002

(65) Prior Publication Data

US 2004/0055263 A1 Mar. 25, 2004

(30) Foreign Application Priority Data

Jan. 11, 2001 (SE) ..... 0100092

(51) Int. Cl.
*A47L 9/10* (2006.01)

(52) U.S. Cl. ..... 15/348; 15/347; 55/430; 55/432

(58) Field of Classification Search ..... 15/348, 15/347; 55/430, 432
See application file for complete search history.

(56) References Cited

U.S. PATENT DOCUMENTS

| | | | | |
|---|---|---|---|---|
| 3,909,222 | A * | 9/1975 | Caughlin et al. | 55/430 |
| 4,277,265 | A | 7/1981 | Leinfelt | 55/302 |
| 4,584,004 | A * | 4/1986 | Komatsu et al. | 55/430 |
| 5,030,259 | A * | 7/1991 | Bryant et al. | 55/432 |
| 5,697,293 | A * | 12/1997 | Mogenier | 15/348 |
| 6,110,242 | A * | 8/2000 | Young | 55/430 |
| 6,168,641 | B1 | 1/2001 | Tuvin et al. | 55/337 |
| 6,290,752 | B1 * | 9/2001 | Koller et al. | 55/430 |
| 2005/0125943 | A1 * | 6/2005 | Sjoberg et al. | 15/404 |

FOREIGN PATENT DOCUMENTS

| | | |
|---|---|---|
| JP | 4-370030 A | 12/1992 |
| WO | WO 00/49932 A1 | 8/2000 |

* cited by examiner

*Primary Examiner*—Theresa T. Snider
(74) *Attorney, Agent, or Firm*—Pearne & Gordon LLP

(57) ABSTRACT

A device for a vacuum cleaner comprising a particle separator, which is provided with an inlet (11) for dust laden air, an outlet (16) for the separated particles, and an outlet (14) for cleaned air that is connected to a vacuum source (14). The particle outlet (16) is connected to a screw conveyor (18, 19), which is provided with an outlet part ending in a mainly closed collecting chamber (23) for the separated particles.

9 Claims, 1 Drawing Sheet

VACUUM CLEANER DEVICE WITH A SCREW CONVEYOR

Figure 1:
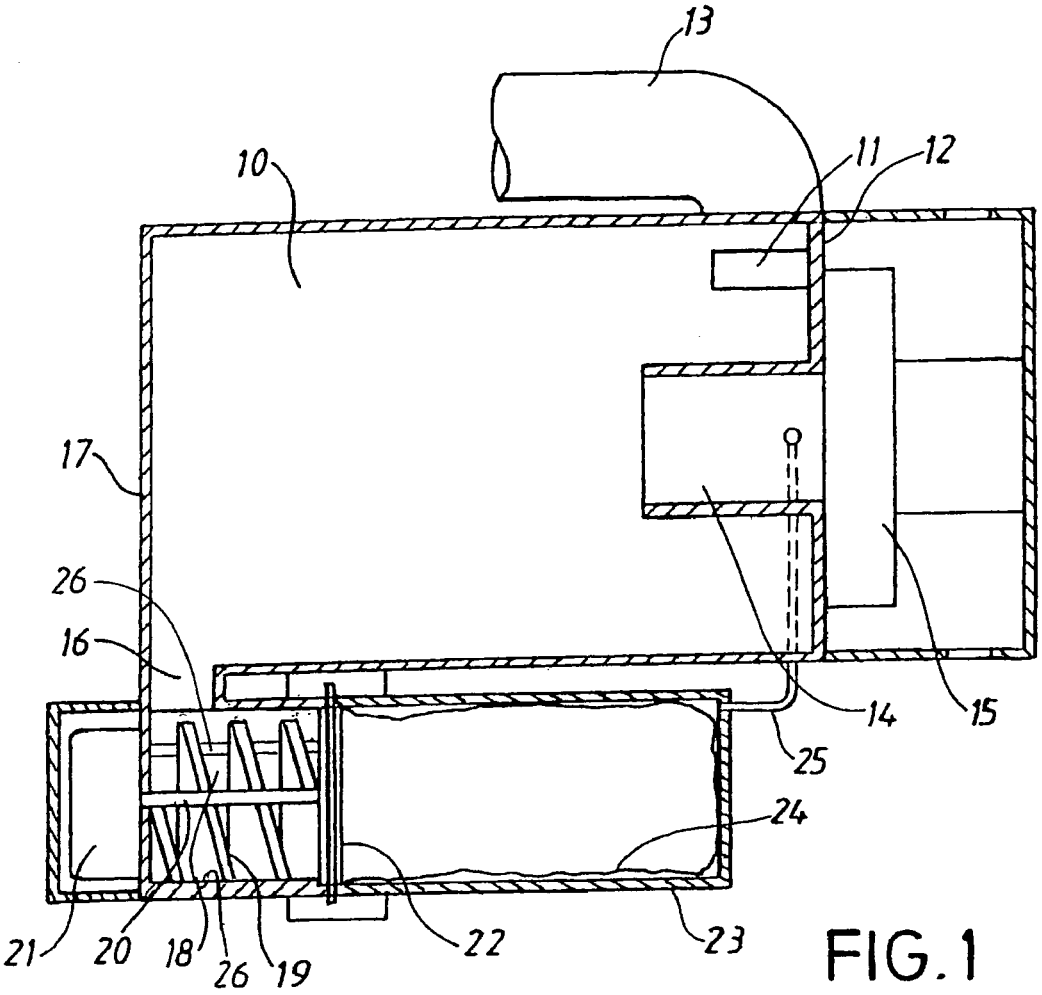

This application claims the benefit of International Application Number PCT/SE01/02878, which was published in English on Jul. 18, 2002.

BACKGROUND OF THE INVENTION

This invention relates to a device for a vacuum cleaner with a particle separator, which is provided with an inlet for dust-laden air, an outlet for the separated particles, and an outlet for cleaned air.

Vacuum cleaners that separate particles from an airflow by cyclonic action are previously known, see for instance U.S. Pat. No. 4,463,748. Such vacuum cleaners do not use traditional filter bags where dust particles are separated from the dust-laden air, but are instead provided with a container where dust particles are collected when the airflow is rotated in a cylindrical separation chamber. Due to the centrifugal forces, the particles are thrown towards the periphery of the chamber where the inlet of the container is placed. When the container has been filled, it is removed from the vacuum cleaner and is emptied into a bin or the like. However, this is not satisfactory from a hygienic point of view. Consequently, other arrangements have been suggested, see U.S. Pat. No. 6,168,641. According to this arrangement, the collecting container is provided with a bag, for instance, a plastic bag where the dust particles are collected. When the bag has been filled, it is removed and thrown away together with the content of the bag.

A disadvantage with these two arrangements is that the filling state of the container or the bag varies depending on the type of particles that the dust-laden air brings into the container. Thus, the container fills quickly if the dust-laden air comprises large, light particles, for instance, fluff, whereas the filling procedure takes more time if the air comprises compact, heavy particles, such as pebbles or gravel. In the first case, a low filling state is achieved, whereas the filling state in the latter case is much larger.

A normal vacuum cleaning operation usually means a comparatively moderate filling state. The material collected in the container could be conveyed further into the collecting container and also could become somewhat compacted in order to create a space in the container for additional dust collecting before the container is emptied. Such devices have up to now not been suggested for cyclonic vacuum cleaners even though the compaction principle as such is previously known, see JP 4370034.

It is also previously known with conventional vacuum cleaners of the canister type, i.e., vacuum cleaners comprising filtrating dust bags in which the dust is collected, to use compaction means for the bag and its content. This compaction of the bag is effected by a bellow and the under-atmospheric pressure created by the vacuum cleaner, see U.S. Pat. No. 4,277,265. However, such an arrangement is because of the differences with regard to the design between a cyclone vacuum cleaner and a conventional vacuum cleaner of the canister type and is not well suited to be used with cyclonic vacuum cleaners.

BRIEF SUMMARY OF THE INVENTION

This invention achieves a simple dust collecting system for cyclone vacuum cleaners and creates a level sensing means for the dust in the collecting container. This is achieved by means of a device having a particle separator, which is provided with an inlet for dust laden air, an outlet for the separated particles that is connected to a screw conveyor, and an outlet for cleaned air that is connected to a vacuum source. The screw conveyor is provided with an outlet part ending in a mainly closed chamber for collecting the separated particles.

BRIEF DESCRIPTION OF THE INVENTION

Figure 2:
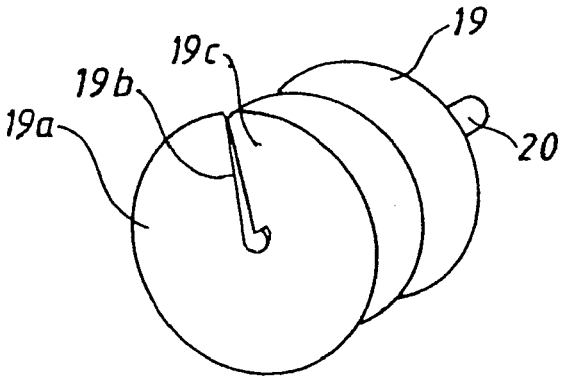

An embodiment of the invention will now be described with reference to the accompanying figures in which:

FIG. 1 schematically shows a vertical section through a cyclone vacuum cleaner with a conveying and/or compaction device of an embodiment of the invention; and FIG. 2 is a perspective view of a screw used in the device.

DETAILED DESCRIPTION OF THE INVENTION

The vacuum cleaner, shown in FIG. 1, comprises a cylindrical separation chamber 10 having an inlet 11 for dust-laden air. The inlet is placed close to a first end wall 12 of the chamber 10. The inlet 11 is connected to an inlet tube 13 to which a vacuum cleaner nozzle (not shown) is connected and is designed such that air mainly flows in tangentially with respect to the chamber 10. The chamber 10 is also provided with a tube-shaped outlet 14 for cleaned air. This tube-shaped outlet 14 is coaxially to the chamber 10 and extends from said end wall 12 somewhat into the chamber. The tube-shaped outlet 14 is connected to a vacuum source, for instance, a fan unit 15 driven by an electric motor (not shown).

The chamber 10 also has a particle outlet 16 arranged close to a second end wall 17 of the separation chamber 10. The particle outlet 16 is connected to a cylindrical conveying chamber 18, which together with a screw 19 constitutes a screw conveyor or compactor for the particles flowing through the particle outlet 16. The screw 19 has a thin shaft 20, which is driven by an electric motor 21, and extends to a sealing device, which is generally denoted 22 and might be of the type that is mentioned in PCT/SE01/02421. The screw 19 might also be designed in such a way that it has no real shaft. Instead, the adjacent screw threads may have such a shape that they continue into one another and together form a portion connecting the different screw threads with one another. The axial direction of the conveying chamber 18 in the embodiment shown is parallel to the axial direction of the separation chamber 10, but it is of course also possible to place the conveying chamber 18 differently, for instance, such that its axial direction is perpendicular to the axial direction of the separation chamber 10. The electric motor 21 is preferably connected to an electric circuit of the vacuum cleaner in such a manner that the current or power demand of the electric motor is measured and gives a signal, which in a suitable way is used to indicate the filling state of the collecting container.

The sealing device 22 limits a collecting container 23, which is closed and mainly has the same section area as the conveying chamber 18. A bag 24 is inserted into the collecting container 23. The collecting container 23 communicates via a tube connection 25 with the tube-shaped outlet 14 for cleaned air such that a pressure difference is established between the outside and the inside of the bag 24 so that the bag is sucked towards the collecting container wall.

The screw 19 has several screw threads, as shown in FIG. 2, with the outer screw thread 19*a* facing towards the collecting container 23. The screw 19 is preferably made of hard plastic. The outer screw thread 19*a* might be designed such that it is elastic and its edge portion 19*b* is normally urged towards the following screw thread 19*c* and thereby closes the opening between the two screw threads 19*a* and 19*c*. The inner wall of the conveying chamber 18 is also provided with several ribs 26 extending in the axial direction of the chamber 18 and the outer diameter of the screw such that the outer portion of the screw threads are placed close to the inner portions of the ribs 26.

The device operates in the following way. When the vacuum source 15 is activated, dust-laden air is sucked from the nozzle (not shown) through the inlet tube 13 and the inlet 11 into the cylindrical separation chamber 10. Because of the tangential inlet 11, the air creates a vortex about the central longitudinal axis of the separation chamber 10 whereby the particles in the air under the influence of the centrifugal forces are thrown towards the periphery of the chamber at the same time as they flow towards the second end wall 17 before they leave through the particle outlet 16, which preferably is spiral shaped in section. At the same time, the cleaned air is sucked from the center of the vortex via the air outlet 14 to the vacuum source from which the air flows to atmosphere.

From the particle outlet 16, the particles flow into the conveying chamber 18 where they are conveyed into the bag 24 inserted in the collecting container 23 by means of the screw 19 driven by the electric motor 21. When the dust particles successively flow into the container 23 and hence into the bag 24, it is successively filled. When the space in the container is filled, additional dust particles are conveyed into the container by means of the screw 19 until the container has achieved a suitable filling state. This filling state is measured by the current or the power used by the electric motor 21 and is indicated in a suitable way and can act on the functions of the device, for instance, by switching off the electric motor of the conveyer and/or the vacuum source of the vacuum cleaner. When the screw 19 has finished rotating the feeding through, the screw ceases. If the screw 19 is provided with an elastic outer screw thread 19*a*, the edge portion 19*b* of the outer screw thread 19*a* will be pressed against the following screw thread 19*c* such that the opening between the two screw threads is closed, thereby preventing the particles that are inside the screw 19 from falling out when the collecting container 23 is separated from the conveying chamber 18. Then, the sealing device 22 is activated and the opening of the bag 24 is closed, after which the collecting container 23 can be removed together with the bag 24 such that the bag 24 becomes accessible and can be taken out from the container and be thrown away.

While the invention has been described with reference to a specific embodiment, various changes may be made and equivalents may be substituted for elements thereof by those skilled in the art without departing from the scope of the invention. In addition, other modifications may be made to adapt a particular situation or method to the teachings of the invention without departing from the essential scope thereof. The present invention herein is not to be construed as being limited, except insofar as indicated in the appended claims.

What is claimed is:

1. A device for a vacuum cleaner comprising a particle separator, which is provided with an inlet (11) for dust laden air, an outlet (16) for the separated particles that is connected to a screw conveyor (18, 19), and an outlet (14) for cleaned air that is connected adjacently to a vacuum source (15) to expel the cleaned air out of the device; wherein the screw conveyor (18, 19)is provided with an outlet part ending in a mainly closed chamber (23) for collecting the separated particles, wherein the screw conveyor comprises a screw (19) and a wall surface surrounding the screw and forming a conveying chamber (18), wherein the closed chamber (23) is formed by an extension of the wall surface of the conveying chamber (18).

2. The device according to claim 1, wherein the screw (19) of the screw conveyor is rotated by an electric motor (21), wherein a current or power demand of the electric motor being used indicates the filling state of the closed chamber (23) and wherein the amount of current or power demand of the electric motor being used signals a means for controlling the operation of the device.

3. The device according to claim 2, wherein the means for controlling the operation of the device is used to control the electric motor of the conveyor and/or an electric motor connected to the vacuum source.

4. The device according to claim 1, wherein the particle separator comprises a mainly cylindrical chamber (10) in which the inlet (11) for the dust laden air is placed such that the air mainly flows in tangentially at a first end wall (12) of the chamber, whereas the particle outlet (16) is placed at the other end wall (17) of the chamber and that the outlet (14) for cleaned air is placed centrally in the cylindrical chamber.

5. The device according to claim 4, wherein the screw conveyor is arranged such that an axial direction of the screw (19) is mainly parallel to or mainly perpendicular to an axial direction of the cylindrical chamber (10) of the particle separator.

6. The device according to claim 1, wherein at least an outer part (19*a*) of the screw (19), which faces the closed chamber, is made of an elastic material.

7. The device according to claim 1, wherein a sealing device (22) for a bag inserted into the closed chamber (23) is placed between the screw conveyor (18, 19) and the closed chamber (23).

8. The device according to claim 1, wherein the wall surface of the conveying chamber (18) is provided with several ribs (26) extending in an axial direction of the conveying chamber (18).

9. The device according to any of the preceding claims, wherein the collecting chamber (23) via a tube connection (25) communicates with the air flow to the vacuum source such that a pressure difference is established between the outside and the inside of a bag (24) inserted into the collecting chamber and in such a manner that the bag is sucked against the surrounding wall of the closed chamber.

* * * * *